United States Patent [19]

Weterings

[11] 4,174,488

[45] Nov. 13, 1979

[54] ELECTRIC LAMP

[75] Inventor: Petrus J. J. Weterings, Eindhoven, Netherlands

[73] Assignee: U.S. Philips Corporation, New York, N.Y.

[21] Appl. No.: 829,734

[22] Filed: Sep. 1, 1977

[30] Foreign Application Priority Data

Sep. 22, 1976 [NL] Netherlands ..... 7610507

[51] Int. Cl.[2] ..... H01K 1/00

[52] U.S. Cl. ..... 313/315; 362/255; 362/363

[58] Field of Search ..... 362/363, 326, 329, 255, 362/; 313/315

[56] References Cited

U.S. PATENT DOCUMENTS 3,940,606 2/1976 Lemons ..... 362/263

*Primary Examiner*—Stephen J. Lechert, Jr.

*Attorney, Agent, or Firm*—Robert S. Smith

[57] ABSTRACT

Halides of Mn, Ba, Ca, Sr, Ce and La are used as a binder for getters in electric lamps. They have the advantage over organic binders of producing no oxygen-containing decomposition products when the lamps are put in operation.

1 Claim, 1 Drawing Figure

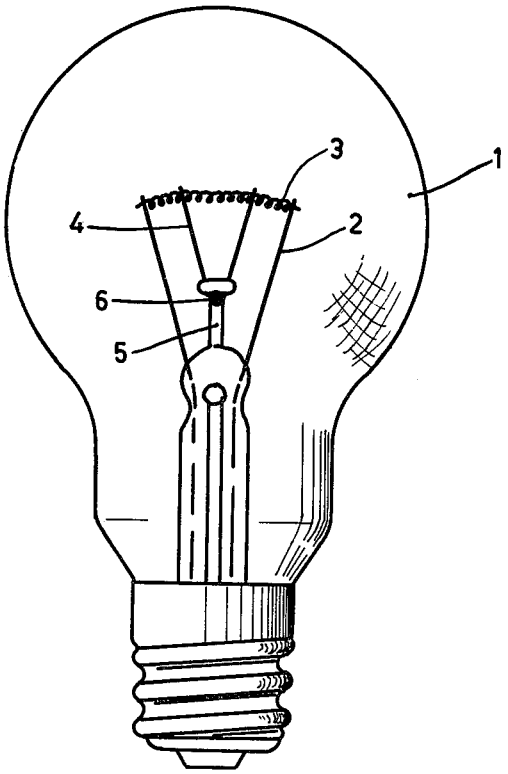
1
2
3
4
5
6

ELECTRIC LAMP

The invention relates to an electric lamp having a light-pervious lamp envelope in which a mixture of an oxygen getter and a binder is present.

Even in careful manufacture of electric lamps it cannot be prevented that small quantities of oxygen remain in a lamp envelope. In order to prevent a detrimental influence thereof on metal parts in the lamp, substances are provided in the lamp envelope which bind oxygen.

According to German Patent Specification 461,189 a moulded body is formed from a finely divided oxygen getter by means of nitrocellulose as a binder and is placed in the lamp envelope.

U.S. Pat. No. 3,253,575 describes a device with which a suspension of a gettering metal powder can be provided on an inner lamp part. In this specification the use of nitrocellulose as a binder is also mentioned.

Often the oxygen getter is heated to such a temperature that the binder decomposes only when the finished lamp is operated for the first time. This involves that such a quantity of decomposition products such as $H_2O$, CO and $CO_2$ is released in a short period of time that the oxygen present therein nevertheless causes attack of the metal parts of the lamp.

It is the object of the invention to provide lamps in which the getter binder does not give off oxygen-containing decomposition products upon heating.

According to the invention, electric lamps of the kind mentioned in the preamble are characterized in that a halide of a metal selected from the group consisting of Mn, Ba, Ca, Sr, Ce and La is used as a binder.

The halides to be considered for use in addition to the iodides are notably the fluorides, chlorides and bromides. The chlorides are particularly suitable.

The getter may be provided in the lamp together with the binder, dispersed in a polar organic solvent. In order to prevent that a quantity of dispersed getter becomes too concentrated for use, a solvent is preferably chosen which can easily be removed upon evacuating the lamp, but which does not evaporate too much when stored in air. As an example may be mentioned ethyleneglycol monoethyl ether, and particularly ethanol.

If desired, glass powder may be incorporated in the getter dispersion as a filler.

The dispersion may be provided in a place which during operation of the lamp has a sufficiently high temperature to cause the getter to become operative, for example, on current supply conductors, supporting members and glass parts of a lamp mount.

Examples of getter dispersions which may be used in the manufacture of lamps according to the invention are

| | | | |
|---|---|---|---|
| Zr powder | 10 grams | Zr powder | 10 grams |
| $MnBr_2$ | 7 grams | $MnCl_2$ | 5 grams |
| ethanol | 10 mls | glass powder | 5 grams |
| | | ethanol | 10 mls. |

The FIGURE shows an embodiment of an incandescent lamp according to the invention.

The lamp comprises a glass lamp envelope 1 in which a filament 3 is stretched between two current supply conductors 2 and is supported by wires 4. A getter 6 is provided on the glass rod 5.

What is claimed is:

1. An electric lamp which comprises: a light-pervious lamp envelope, a mixture of an oxygen getter and a binder disposed in said envelope, said binder being a halide of a metal selected from the group consisting of Mn, Ba, Ca, Sr, Ce and La.

* * * * *